US008597064B2

(12) United States Patent
Lefavour et al.

(10) Patent No.: US 8,597,064 B2
(45) Date of Patent: Dec. 3, 2013

(54) POWDER ACTUATED TOOL AND CONNECTOR

(75) Inventors: John D. Lefavour, Litchfield, NH (US); Lawrence Brown, Center Barnstead, NH (US)

(73) Assignee: Hubbell Incorporated, Shelton, CT (US)

( * ) Notice: Subject to any disclaimer, the term of this patent is extended or adjusted under 35 U.S.C. 154(b) by 279 days.

(21) Appl. No.: 12/930,227

(22) Filed: Dec. 30, 2010

(65) Prior Publication Data

US 2011/0154652 A1 Jun. 30, 2011

Related U.S. Application Data

(60) Provisional application No. 61/335,129, filed on Dec. 30, 2009.

(51) Int. Cl.
*H01R 4/50* (2006.01)

(52) U.S. Cl.
USPC ..... 439/783

(58) Field of Classification Search
USPC ..... 439/783; 29/421.2
See application file for complete search history.

(56) References Cited

U.S. PATENT DOCUMENTS

| | | | | |
|---|---|---|---|---|
| 2,003,843 | A * | 6/1935 | Temple, Jr. | 72/312 |
| 2,770,194 | A | 11/1956 | Kopf et al. | |
| 2,771,696 | A | 11/1956 | Kopf et al. | |
| 3,060,435 | A | 10/1962 | Ivins et al. | |
| 3,129,663 | A * | 4/1964 | Schnepfe, Jr. | 102/275.4 |
| 3,212,534 | A | 10/1965 | Broske | 140/113 |
| 3,212,535 | A | 10/1965 | Broske | |
| 3,257,499 | A | 6/1966 | Broske | 174/94 |
| 3,292,363 | A | 12/1966 | Wahl | 60/26.1 |
| 3,296,792 | A | 1/1967 | Hedberg et al. | 60/26.1 |
| 3,329,928 | A * | 7/1967 | Broske | 439/783 |
| 3,343,294 | A | 9/1967 | Frederick | |
| 3,473,718 | A | 10/1969 | Wackrow | |
| 4,282,714 | A | 8/1981 | Fiocchi | |
| 4,533,205 | A * | 8/1985 | Frank | 439/783 |
| 4,722,189 | A | 2/1988 | Center | 60/635 |
| 4,730,087 | A * | 3/1988 | Werner | 174/94 S |

(Continued)

FOREIGN PATENT DOCUMENTS

| | | | |
|---|---|---|---|
| BR | 0106296-4 | A | 9/2003 |
| BR | 0204929-5 | A | 9/2003 |
| MU | 8100185-1 | U | 10/2002 |
| WO | WO-99/36230 | A1 | 7/1999 |

OTHER PUBLICATIONS

Instruction Manual, KF-001 Tool, Kron Instumentos Electricos LTDA, 16 pages.
Photographs of Kron KF-001 Tool and Cardridge Holder, 3 pages.

(Continued)

*Primary Examiner* — Neil Abrams
(74) *Attorney, Agent, or Firm* — Harrington & Smith

(57) ABSTRACT

Disclosed herein is an electrical wedge connector wedge. The electrical wedge connector wedge includes a first end, a second end, a first conductor groove, and an opening. The second end is opposite the first end. The wedge includes a generally tapered shape from the second end to the first end. The first conductor groove extends between the first end and the second end. The opening extends into the second end. The opening is adapted to receive at least a portion of an explosive charge for driving the wedge into an electrical wedge connector shell.

18 Claims, 5 Drawing Sheets

(56) References Cited

U.S. PATENT DOCUMENTS

| | | | | |
|---|---|---|---|---|
| 4,857,020 | A * | 8/1989 | Crosby | 439/783 |
| 4,905,603 | A | 3/1990 | McBain | 102/530 |
| 4,945,730 | A | 8/1990 | Laney | |
| 5,005,485 | A | 4/1991 | Woo et al. | 102/531 |
| 5,244,422 | A * | 9/1993 | Laricchia | 439/783 |
| 5,337,566 | A | 8/1994 | Lomastro et al. | 60/632 |
| 5,388,499 | A | 2/1995 | Szyndlar | 89/1.14 |
| 5,533,254 | A | 7/1996 | Gallo et al. | 29/750 |
| 5,657,919 | A | 8/1997 | Berry et al. | |
| 5,785,229 | A | 7/1998 | Franzini | 227/10 |
| 6,062,455 | A | 5/2000 | Giannuzzi et al. | |
| 6,085,958 | A | 7/2000 | Kersten | 227/10 |
| 6,390,861 | B1 * | 5/2002 | DeFrance | 439/783 |
| 6,979,236 | B1 * | 12/2005 | Stanton | 439/783 |
| 7,182,653 | B1 * | 2/2007 | Hoxha | 439/783 |
| 7,328,751 | B2 | 2/2008 | Peterson et al. | 173/1 |
| 7,387,546 | B2 * | 6/2008 | Copper et al. | 439/781 |

OTHER PUBLICATIONS

Diagram, "Small Ampact Tool", AMP Tyco Electronics Canada Ltd., 1 pg.

Product Brochure, "The Wejtap™ System", Burndy Products, Feb. 2009, 4 pgs.

* cited by examiner

POWDER ACTUATED TOOL AND CONNECTOR

CROSS REFERENCE TO RELATED APPLICATION

This application claims priority under 35 U.S.C. §119(e) to U.S. provisional patent application No. 61/335,129 filed Dec. 30, 2009 which is hereby incorporated by reference in its entirety.

BACKGROUND

1. Field of the Invention

The invention relates to an electrical connector tool and connector and, more particularly, to a powder actuated electrical connector tool and connector.

2. Brief Description of Prior Developments

U.S. Pat. Nos. 4,722,189, and 7,328,751, which are hereby incorporated by reference in their entireties, disclose explosively-operated tools. These tools generally provide an assembly to connect an electrical wedge connector to conductors of electrical power distribution systems. As maintenance and installation operations for the electrical power distribution systems become increasingly difficult, the added time required for these operations can increase operating costs for the utility company.

Accordingly, there is a need for an improved electrical connector tool and electrical connector which allows for facilitated installation while maintaining a robust and reliable product configuration.

SUMMARY

The foregoing and other problems are overcome, and other advantages are realized, by the use of the exemplary embodiments of this invention.

In accordance with one aspect of the invention, an electrical wedge connector wedge is disclosed. The electrical wedge connector wedge includes a first end, a second end, a first conductor groove, and an opening. The second end is opposite the first end. The wedge includes a generally tapered shape from the second end to the first end. The first conductor groove extends between the first end and the second end. The opening extends into the second end. The opening is adapted to receive at least a portion of an explosive charge for driving the wedge into an electrical wedge connector shell.

In accordance with another aspect of the invention, an electrical wedge connector installation tool is disclosed. The electrical wedge connector installation tool includes a main section and a firing ram. The firing ram extends from the main section in a first direction. The tool is adapted to impact an electrical wedge connector wedge in the first direction. The firing ram is adapted to receive gasses of an explosive charge in a direction opposite the first direction.

In accordance with another aspect of the invention, an electrical wedge connector wedge is disclosed. The electrical wedge connector wedge includes a body and a firing pin. The body has a first end, a second end opposite the first end, and a middle section between the first end and the second end. The body includes a generally tapered shape from the second end to the first end. The body includes a first conductor groove extending along a side of the body between the first end and the second end. The wedge is adapted to be inserted into an electrical wedge connector shell by an installation tool. The firing pin is at the middle section. The firing pin is adapted to contact an explosive charge of the installation tool.

In accordance with another aspect of the invention, an electrical wedge connector installation tool is disclosed. The electrical wedge connector installation tool includes a main section and a firing ram. The firing ram includes a first end and a second end. The first end is at the main section. The second end is spaced from the main section. The second end is adapted to be received by an electrical wedge connector wedge. The second end includes a cartridge receiving area. The cartridge receiving area is adapted to receive an explosive cartridge used in the tool.

In accordance with another aspect of the invention, a method of using an electrical wedge connector installation tool is disclosed. An end of a firing ram is located proximate an opening of an electrical wedge connector wedge. An explosive cartridge is installed between the end of the firing ram and the electrical wedge connector wedge. The ram is moved towards the wedge. The explosive cartridge is struck with a firing pin in response to the moving of the ram.

BRIEF DESCRIPTION OF THE DRAWINGS

The foregoing aspects and other features of the invention are explained in the following description, taken in connection with the accompanying drawings, wherein.

DETAILED DESCRIPTION

Figure 1:
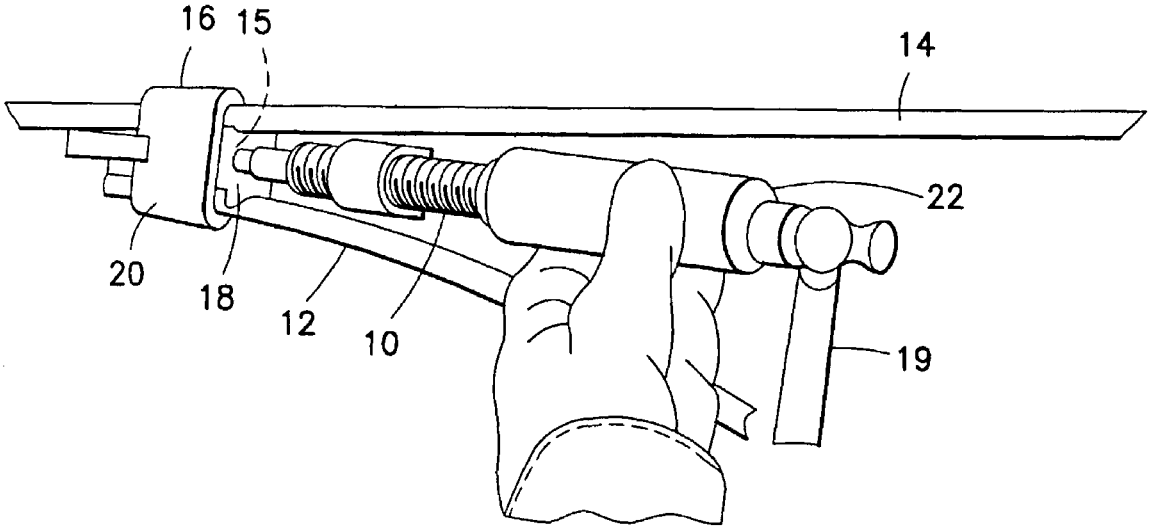
FIG. 1 is a perspective view of a tool and electrical connector incorporating features of the invention.

Referring to FIG. 1, there is shown a perspective view of a tool 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The tool 10 is used for connecting a branch or tap wire 12 to a main power line 14. The electrical wedge connector 16 includes a wedge 18 and a C-shaped sleeve 20. The tool 10 uses a charge (or cartridge/load) 15 to drive the wedge 18 into the sleeve (or shell) 20 sandwiching the wire 12 and line 14 against opposite ends of the sleeve 20. The tool is fired by a user striking the rear end 22 of the tool 10 with a hand-held hammer 19.

Figure 2:
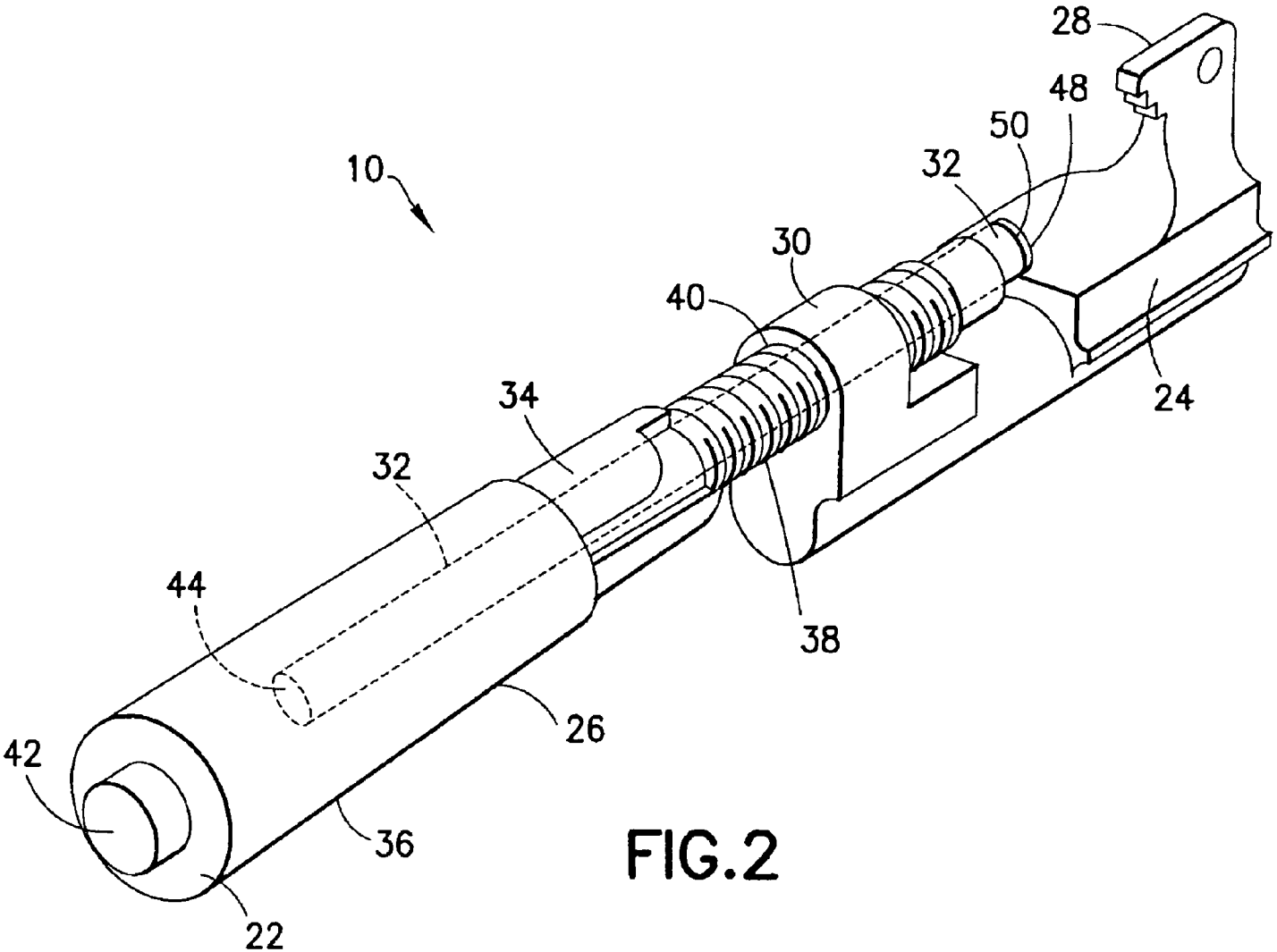
FIG. 2 is a perspective view of the tool shown in FIG. 1.

Referring also to FIG. 2, there is shown an enlarged perspective view of the tool 10. The tool 10 may be a hammer actuated connecting tool. The tool 10 includes a frame 24 and a tool body 26. The frame 24 comprises an anvil section 28. The tool body 26 is adjustably connected to the frame 24. The tool body 26 is fitted through a support sleeve 30 at an end of the anvil section 28 to position the ram 32 along the longitudinal axis of the tool 10. The tool body 26 comprises the ram 32 which is adapted to contact the charge 15 in order to initiate the advancement of the wedge 16, to wedge the two cables 12, 14 into the shell 20 to drive the wedge 18 into its final position.

The tool body 26 includes a main section 34, and a movable outer section 36. The main section 34 has a threaded section 38 inserted into the support sleeve 30 for adjustment of the tool body 26 with respect to the anvil section by means of a threaded connection 40. This adjustable connection can be used for advancing and retracting the tool body 26 and the ram 32 relative to the opposite side of the anvil section for engagement with the connector. The main section 34 is threaded along its forward surface at the threaded section 38. The main section 34 includes a longitudinal axial bore for slidably receiving the ram 32.

The main section 34 comprises a general cylindrical shape. The movable outer section 36 is slidably fitted over the main section 34. The movable outer section 36 may also comprise a general cylindrical shape. A striker 42 may further be provided at the rear end 22 of the movable section 36. The striker 42 is adapted to be hit by the hand-held hammer 19 (see FIG. 1). According to one embodiment of the invention, when the striker 42 is hit by the hammer 19, this causes the movable outer section 36 to move in a direction towards the frame 24, wherein an interior end portion of the section 36 contacts an end 44 of the ram 32. According to another embodiment of the invention, the striker 42 may be movably connected to the outer section 36 such that when the striker 42 is hit by the hammer 19, this causes the striker 42 to move in a direction towards the frame 24, wherein an opposite end of the striker 42 contacts the end 44 of the ram 32. However, any suitable configuration for advancing the ram may be provided.

Figure 3:
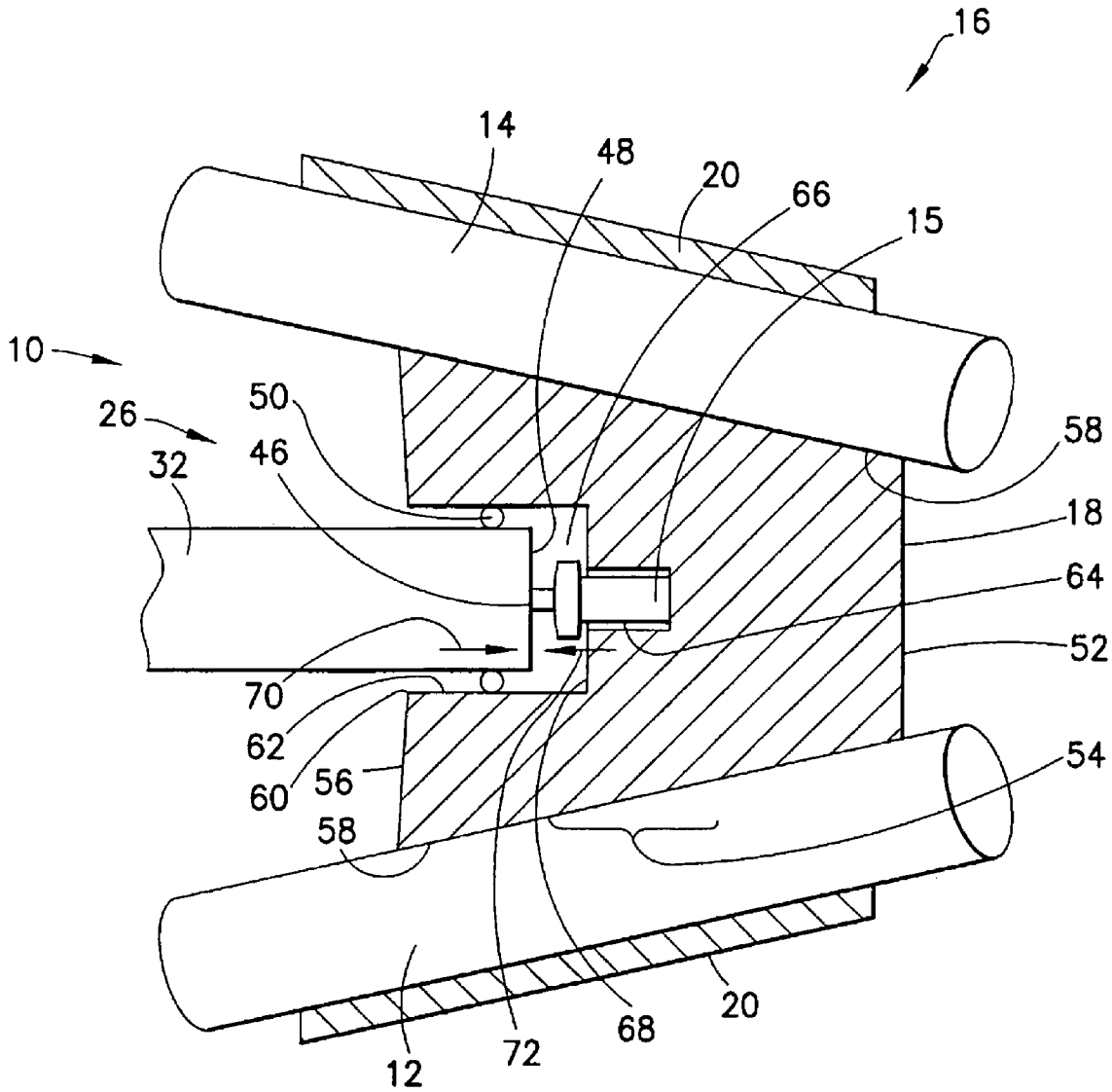
FIG. 3 is a section view of the electrical connector shown in FIG. 1.

Referring now also to FIG. 3, the ram 32 comprises a firing pin portion 46 at the end 48 of the ram 32. The firing pin portion 46 is suitably located to be aligned with the cartridge 15. Additionally, a seal 50 is provided at the ram 32 proximate the end 48.

The electrical wedge connector wedge 18 includes a front end 52, a middle section 54, and a rear end 56. The rear end 56 is opposite the front end 52. The middle section 54 is between the front end 52 and the rear end 56. The wedge 18 comprises a generally tapered shape from the rear end 56 to the front end 52. Additionally, the wedge 18 includes conductor grooves 58 on sides of the wedge 18 extending between the front end 52 and the rear end 56. The wedge 18 further includes an opening 60 extending into the rear end 56. The opening 60 is adapted to receive the explosive charge for driving the wedge into the electrical wedge connector shell.

The opening 60 includes a first portion 62 and a second portion 64. The first portion 62 forms a ram receiving channel adapted to receive the firing ram 32. The second portion 64 forms a cartridge receiving seat adapted to removably receive the explosive cartridge 15. The receiving seat 64 may be suitably sized and shaped to receive the cartridge 15 in a press fit or friction fit for example.

When the firing ram 32 is inserted in to the ram receiving channel 62, the seal 50, which may be an O-ring seal for example, contacts the ram receiving channel 62 and forms a gas expansion area (or cavity) 66 between the end 48 of the ram 32 and the end 68 of the channel 66 (as the O-ring 50 forms a seal between the ram 32 and the channel 62). In this embodiment, the gas expansion area has a general cylindrical shape to direct expanding gases from a fired cartridge against the end 48 of the ram 32. However, it should be noted that in an alternate embodiment the gas expansion area might not be provided.

To use the tool 10 to connect the electrical wedge connector 16 to the conductors 12, 14, the connector sleeve 20, the wedge 18 and the two conductors 12, 14 (see FIG. 1) are located and positioned at the anvil section 28. The tool body 26 is rotated by the operator relative to the anvil section 28. This causes the threads 38 of the main section 34 and the support sleeve 30 to move the tool body 26 towards the anvil section 28. The operator stops rotating the tool body 26 when the anvil section 28 and the ram 32 sandwich the connector sleeve, conductors, and wedge therebetween such that the front end 48 of the ram 32 is in the receiving channel 62 and proximate the cartridge 15.

The operator may then strike the striker 42 (or the end 22 of the movable outer section 36) with a hand held tool, such as the hand-held hammer 19. This causes the movable outer section 36 to move forward and apply a force to the end 44 of the movable firing ram 32. The force applied to the ram 32 causes the firing pin portion 46 at the end 48 of the ram 32 to come into contact with the cartridge 15. This causes the firing pin portion 46 to ignite a primer of the cartridge 15 to thereby fire the cartridge 15. The gases from the cartridge 15 move into the cavity 66 and push against the wedge 18 (at the end 68 of the ram receiving channel 62) to thereby drive the wedge 18 into the connector sleeve 20 with the cables 12, 14 therebetween in a very tight electrical and mechanical connection. This, for example, provides a firing ram 32 adapted to impact the electrical wedge connector wedge 18 in a first direction 70, and wherein the firing ram is adapted to receive gasses of the explosive charge in a second direction 72. According to one embodiment, the cartridge may comprise a vented rim to allow for the gasses to move from the cartridge 15 to the cavity 66. However, any suitable configuration may be provided.

Once the connection is completed, the tool body 26 is unscrewed from the anvil 28, thus backing the ram off of the connector wedge. The tool 10 is then removed from the completed connection. The spent cartridge 15 may then be removed from the wedge.

Figure 4:
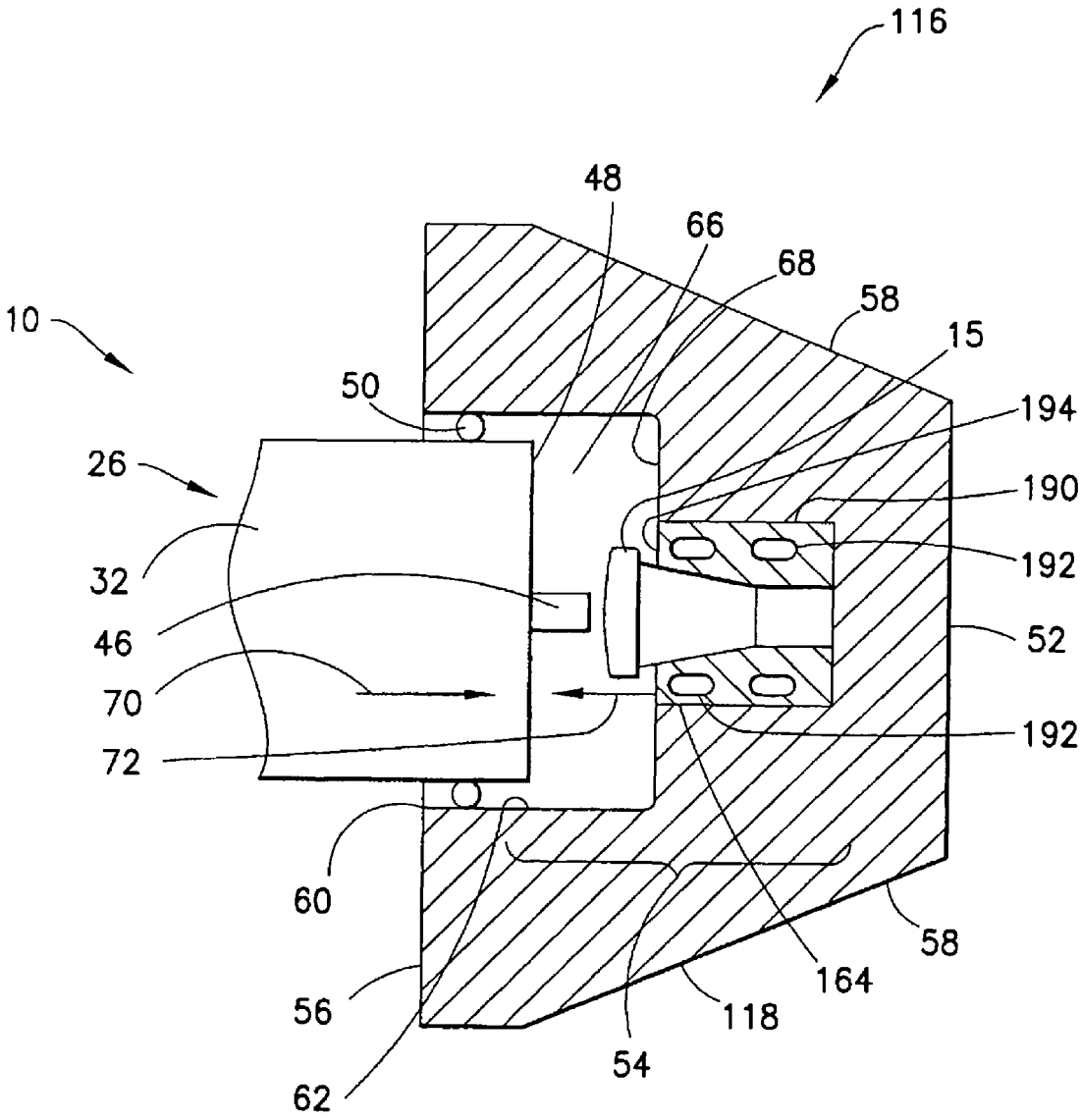
FIG. 4 is a section view of an electrical connector in accordance with an alternate embodiment used with the tool shown in FIG. 1.

Referring now also to FIG. 4, an electrical wedge connector 116 in accordance with an alternate embodiment of the invention is shown. The electrical wedge connector 116 is similar to the electrical wedge connector 16 and similar features are similarly numbered. Similar to the embodiment described above, the electrical wedge connector 116 includes a wedge 118 and the sleeve 20. Also similar to the embodiment described above, the tool 10 is configured to drive the wedge 118 into the sleeve 20 to sandwich the wire 12 and line 14 against opposite ends of the sleeve 20. It should be noted that the sleeve 20 is not shown in FIG. 4 for the purposes of clarity.

The wedge 118 comprises a similar configuration as the wedge 18. For example, the wedge 118 includes a front end 52, a middle section 54, and a rear end 56. The wedge 118 also comprises a generally tapered shape from the rear end 56 to the front end 52 and includes conductor grooves 58 on sides of the wedge 118. The wedge 118 further includes an opening 60 extending into the rear end 56. The opening 60 is adapted to receive the explosive charge 15 for driving the wedge 118 into the electrical wedge connector shell 20.

However, one difference between the wedge 118 and the wedge 18 is that the wedge 118 is configured to receive a bushing at the opening. The opening 60 includes a first portion 62 and a second portion 64. The first portion 62 forms a ram receiving channel adapted to receive the firing ram 32. The second portion 164 forms a bushing receiving area to receive the bushing 190. The bushing 190 may be a vented bushing, wherein the bushing 190 comprises openings 192 vented to the cavity 66. However, in alternate embodiments, any suitable type bushing may be provided. The bushing 190 comprises a cartridge receiving seat 194 adapted to removably receive the explosive cartridge 15. The receiving seat 194 may be suitably sized and shaped to receive the cartridge 15 in a press fit or friction fit for example.

In this embodiment, the gases from the cartridge 15 move into the cavity 66 through the openings 192 in the bushing and push against the wedge 118 (at the end 68 of the ram receiving channel 62) to thereby drive the wedge 118 into the connector sleeve 20 with the cables 12, 14 therebetween in a very tight electrical and mechanical connection. This, for example, provides a firing ram 32 adapted to impact the electrical wedge connector wedge 118 in the first direction 70, and wherein the firing ram 32 is adapted to receive gasses of the explosive charge 15 in a second direction 72. Although this embodiment describes the vented bushing as allowing for the gasses to move from the cartridge 15 to the cavity 66, it should be noted that a cartridge with a vented rim may also be used instead of, or in addition to, the vented bushing. However, these are merely provided as non-limiting examples, and any suitable configuration may be provided.

Figure 5:
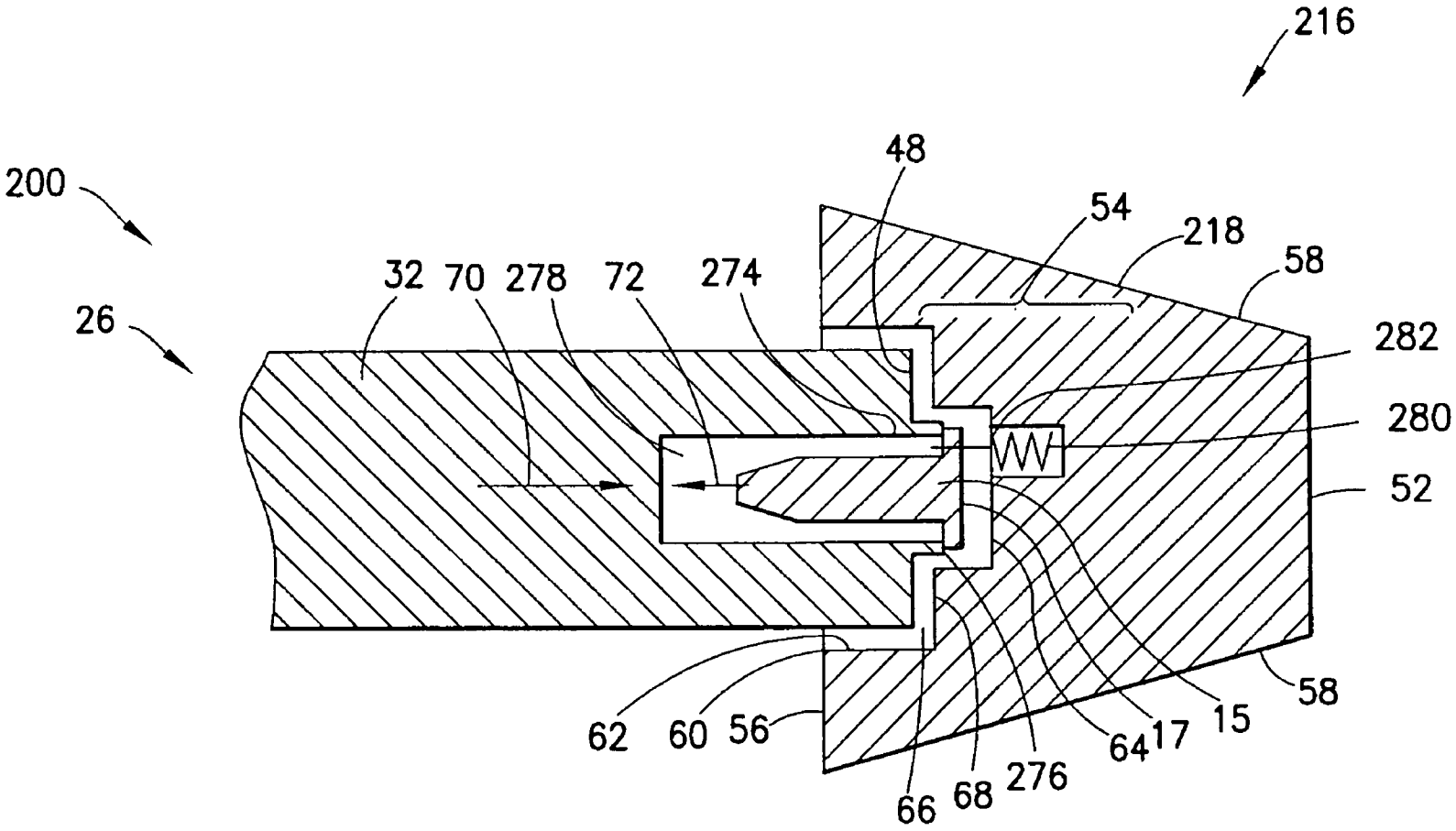
FIG. 5 is a section view of an electrical connector in accordance with another alternate embodiment used with the tool shown in FIG. 1.

Referring now also to FIG. 5, a tool 200 and electrical wedge connector 216 in accordance with another embodiment of the invention are shown. The tool 200 and the electrical wedge connector 216 are similar to the tool 10 and the electrical wedge connector 16, 116 and similar features are similarly numbered. Similar to the embodiments described above, the electrical wedge connector 216 includes a wedge 218 and the sleeve 20. Also similar to the embodiment described above, the tool 200 is configured to drive the wedge 218 into the sleeve 20 to sandwich the wire 12 and line 14 against opposite ends of the sleeve 20. It should be noted that the sleeve 20 is not shown in FIG. 5 for the purposes of clarity.

As mentioned above, the tool 200 is similar to the tool 10. For example the tool 200 comprises a hammer actuated connecting tool including the frame 24 and the tool body 26. It should be noted that the frame 24 and portions of the tool body 24 are not shown in FIG. 6 for the purposes of clarity.

One difference between the tool 200 and the tool 10 is that the tool 200 is configured to receive the charge at an end of the ram. In this embodiment, the ram 32 comprises an opening 274 at the end 48 of the ram 32. An end of the opening forms a cartridge receiving seat 276. The opening 274 is suitably sized and shaped to receive the cartridge 15. Additionally, the cartridge receiving area 276 is substantially aligned with an opening of the electrical wedge connector wedge 218. The opening 274 may further comprise a cavity portion 278 adapted to receive gasses of the explosive charge 15. The opening 274 is adapted to receive the explosive charge 15 for driving the wedge 218 into the electrical wedge connector shell 20.

The wedge 218 comprises a similar configuration as the wedge 18, 118. For example, the wedge 218 includes a front end 52, a middle section 54, and a rear end 56. The wedge 218 also comprises a generally tapered shape from the rear end 56 to the front end 52 and includes conductor grooves 58 on sides of the wedge 218. The wedge 218 further includes an opening 60 extending into the rear end 56.

The opening 60 includes a first portion 62 and a second portion 64. The first portion 62 forms a ram receiving channel adapted to receive the firing ram 32. However, one difference between the wedge 218 and the wedge 18, 118 is that the wedge 218 is configured to receive an end 17 of the cartridge such that the second portion 64 forms a cartridge receiving seat adapted to receive the end 17 of the explosive cartridge 15. The receiving seat 64 may be suitably sized and shaped to receive the end 17 of the cartridge 15.

Another difference between the wedge 218 and the wedge 18, 118 is that the wedge 218 comprises a firing pin 280 at the middle portion 54 of the wedge 218. An end 282 of the firing pin 280 is at the second portion of the opening 60. The firing pin 280 is suitably located to be aligned with the cartridge 15.

To use the tool 200 to connect the electrical wedge connector 216 to the conductors 12, 14, the connector sleeve 20, the wedge 218 and the two conductors 12, 14 are located and positioned at the anvil section as described above.

When the operator strikes the striker 42 (or the end 22 of the movable outer section 36) with a hand held tool, such as the hand-held hammer 19. This causes the movable outer section 36 to move forward and apply a force to the end 44 of the movable firing ram 32. The force applied to the ram 32 causes the end 48 of the ram to fully enter the receiving area 62, and with the cartridge 15 at the cartridge receiving seat 276 of the ram 32, the firing pin 280 of the wedge 218 comes into contact with the cartridge 15. This causes the firing pin 280 to ignite a primer of the cartridge 15 to thereby fire the cartridge 15. The gases from the cartridge 15 move into the cavity 278, which causes pressure between the end 17 of the cartridge 15 and the wedge 218 to push against the wedge 218 to thereby drive the wedge 218 into the connector sleeve 20 with the cables 12, 14 therebetween in a very tight electrical and mechanical connection. This, for example, provides a firing ram 32 adapted to impact the electrical wedge connector wedge 218 in the first direction 70, and wherein the cavity 278 of the firing ram 32 is adapted to receive gasses of the explosive charge 15 in a second direction 72.

According to another embodiment, the ram 32 may comprise the seal 50 as shown in FIG. 2 and the cartridge 15 may comprise a vented rim to allow for the gasses to move from the cartridge to the cavity 66 between the end 48 of the ram 32 and the end 68 of the channel 62 (formed with the seal between the ram 32 and the ram receiving channel 62). According to another embodiment, the end 48 of the ram 32 may comprise a vented bushing (such as in FIG. 4) at the opening 274. This together with the seal 50 at proximate end 48 of the ram (as in FIGS. 3 and 4) to allow for the gasses to move from the cartridge 15 to the cavity 66 between the end 48 of the ram 32 and the end 68 of the channel 62 (formed with the seal between the ram 32 and the ram receiving channel 62). In these alternate embodiments, the cavity 66 would form a gas expansion area to direct expanding gases from the fired cartridge 15 against the end 68 of the wedge 218 to drive the wedge 218 into the shell 20. However, any suitable configuration may be provided.

Once the connection is completed, the ram 32 is removed from the ram receiving section 62 and the spent cartridge 15 may then be removed from the ram 32.

It should be noted that the cartridge 15 may be any suitable cartridge such as a metallic shell cartridge manufactured by Winchester Ammunition, for example. The cartridge may further comprise a standard industrial blank 0.27 caliber cartridge; where the powder level of the cartridge corresponds to the size of the connector. However, in alternate embodiments, the invention could be adapted to incorporate use of any suitable size of cartridge; standard or specifically designed.

According to another example of the invention, a method of using the electrical wedge connector installation tool is disclosed. The method includes the following steps. Locating an end of a firing ram proximate an opening of an electrical wedge connector wedge. Installing an explosive cartridge between the end of the firing ram and the electrical wedge connector wedge. Moving the ram towards the wedge. Striking the explosive cartridge with a firing pin in response to the moving of the ram. It should be noted that any of the above steps may be performed alone or in combination with one or more of the steps.

Below are provided further descriptions of various non-limiting, exemplary embodiments. The below-described exemplary embodiments are separately numbered for clarity and identification. This numbering should not be construed as wholly separating the below descriptions since various aspects of one or more exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

(1) In one exemplary embodiment, an electrical wedge connector wedge comprising: a first end; a second end opposite the first end, wherein the wedge comprises a generally tapered shape from the second end to the first end; a first conductor groove extending between the first end and the second end; and an opening extending into the second end, wherein the opening is adapted to receive at least a portion of an explosive charge for driving the wedge into an electrical wedge connector shell.

An electrical wedge connector wedge as above, wherein the opening comprises a first portion and a second portion, wherein the first portion is adapted to receive a firing ram, and wherein the second portion is adapted to receive the portion of the explosive charge.

An electrical wedge connector wedge as above, further comprising a second conductor groove extending between the first end and the second end.

An electrical wedge connector wedge as above, wherein the wedge is adapted to be insertable into an electrical wedge connector sleeve.

An electrical wedge connector wedge as above, further comprising a second conductor groove extending between the first end and the second end, and wherein the opening comprises a first portion and a second portion, wherein the first portion is adapted to receive a firing ram, and wherein the second portion is adapted to receive the portion of the explosive charge.

An electrical wedge connector wedge as above, wherein the wedge is adapted to be insertable into an electrical wedge connector sleeve.

An electrical wedge connector wedge as above, further comprising a bushing, wherein the bushing is adapted to be fitted between the second portion of the opening and the explosive charge.

An electrical wedge connector comprising: an electrical wedge connector sleeve; and an electrical wedge connector wedge as above, wherein the wedge is insertable into the sleeve, and wherein the connector is adapted to receive a conductor between the wedge and the sleeve.

(2) In another exemplary embodiment, an electrical wedge connector installation tool comprising: a main section; and a firing ram extending from the main section in a first direction, wherein the tool is adapted to impact an electrical wedge connector wedge in the first direction, and wherein the firing ram is adapted to receive gasses of an explosive charge in a direction opposite the first direction.

An electrical wedge connector installation tool as above, further comprising a seal on the firing ram, wherein the seal is adapted to contact the electrical wedge connector wedge.

An electrical wedge connector installation tool as above, wherein the firing ram comprises a cavity adapted to receive the gasses of the explosive charge.

An electrical wedge connector installation tool as above, wherein an end of the firing ram is adapted to be received by on opening of the electrical wedge connector wedge.

An electrical wedge connector installation tool as above, wherein the main section is connected to a frame.

(3) In another exemplary embodiment, an electrical wedge connector wedge comprising: a body having a first end, a second end opposite the first end, and a middle section between the first end and the second end, wherein the body comprises a generally tapered shape from the second end to the first end, wherein the body comprises a first conductor groove extending along a side of the body between the first end and the second end, and wherein the wedge is adapted to be inserted into an electrical wedge connector shell by an installation tool; and a firing pin at the middle section, wherein the firing pin is adapted to contact an explosive charge of the installation tool.

An electrical wedge connector wedge as above, wherein the body comprises an opening at the second end.

An electrical wedge connector wedge as above, wherein the opening comprises a first portion and a second portion, wherein the first portion is adapted to receive a firing ram, and wherein the second portion is adapted to receive a portion of the explosive charge.

An electrical wedge connector wedge as above, wherein the firing pin is at the second portion of the opening.

An electrical wedge connector wedge as above, wherein the body comprises a second conductor groove extending along another side of the body between the first end and the second end.

An electrical wedge connector comprising: an electrical wedge connector sleeve; and an electrical wedge connector wedge as above, wherein the wedge is insertable into the sleeve, and wherein the connector is adapted to receive a conductor between the wedge and the sleeve.

(4) In another exemplary embodiment, an electrical wedge connector installation tool comprising: a main section; and a firing ram comprising a first end and a second end, wherein the first end is at the main section, wherein the second end is spaced from the main section, wherein the second end is adapted to be received by an electrical wedge connector wedge, wherein the second end comprises a cartridge receiving area, and wherein the cartridge receiving area is adapted to receive an explosive cartridge used in the tool.

An electrical wedge connector installation tool as above, wherein the firing ram comprises a cavity adapted to receive the gasses of the explosive charge.

An electrical wedge connector installation tool as above, wherein the cartridge receiving area is adapted to be aligned with a firing pin of the electrical wedge connector wedge.

An electrical wedge connector installation tool as above, wherein the firing ram is adapted to surround a majority of the explosive cartridge at the receiving area.

An electrical wedge connector installation tool as above, further comprising a frame, wherein the main section is movably connected to the frame.

(5) In another exemplary embodiment, a method of using an electrical wedge connector installation tool comprising: locating an end of a firing ram proximate an opening of an electrical wedge connector wedge; installing an explosive cartridge between the end of the firing ram and the electrical wedge connector wedge; moving the ram towards the wedge; and striking the explosive cartridge with a firing pin in response to the moving of the ram.

A method of using an electrical wedge connector installation tool as above, wherein the installing of the explosive cartridge further comprises installing the explosive cartridge in the opening of the electrical wedge connector wedge.

A method of using an electrical wedge connector installation tool as above, wherein the installing of the explosive cartridge further comprises installing the explosive cartridge in an opening at the end of the firing ram.

A method of using an electrical wedge connector installation tool as above, wherein the firing pin is at the end of the firing ram.

A method of using an electrical wedge connector installation tool as above, wherein the firing pin is at the opening of the electrical wedge connector wedge.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical wedge connector wedge comprising:

a first end;

a second end opposite the first end, wherein the wedge comprises a generally tapered shape from the second end to the first end;

a first conductor groove extending between the first end and the second end;

an opening extending into the second end, wherein the opening is adapted to receive at least a portion of an explosive charge for driving the wedge into an electrical wedge connector shell; and a bushing adapted to be fitted between a portion the opening and the explosive charge.

2. An electrical wedge connector wedge as in claim 1 wherein the opening comprises a first portion and a second portion, wherein the first portion is adapted to receive a firing ram, and wherein the second ports adapted receive the portion of the explosive charge.

3. An electrical wedge connector wedge as in claim 1 further comprising a second conductor groove extending between the first end and the second end.

4. An electrical wedge connector wedge as in claim 1 wherein the wedge adapted to be insertable into an electrical wedge connector sleeve.

5. An electrical wedge connector wedge as in claim 1 further comprising a second conductor groove extending between the first end and the second end, and wherein the opening comprises a first portion and a second portion, wherein the first portion is adapted to receive a firing ram, and wherein the second portion is adapted to receive the portion of the explosive charge.

6. An electrical wedge connector wedge as in claim 5 wherein the wedge is adapted to be insertable into an electrical wedge connector sleeve.

7. An electrical wedge connector wedge as in claim 6 wherein the bushing is adapted to be fitted between the second portion the opening and the explosive charge.

8. An electrical wedge connector comprising:

an electrical wedge connector sleeve; and an electrical wedge connect wedge as in claim 1, wherein the wedge is insertable into the sleeve, and wherein the connector is adopted to receive a conductor between the wedge and the sleeve.

9. An electrical wedge connector wedge comprising:

a body having a first end, second end opposite the first end, and a middle section between the first end and the second end, wherein the body comprises a generally tapered shape from the second end to the first end, wherein the body comprises first conductor groove extending along a side the body between the first end and the second end, and wherein the wedge is adapted to be inserted into an electrical wedge connector shell by an installation tool; and firing pin at the middle section, wherein the firing pin is adapted contact an explosive charge of the installation tool.

10. An electrical wedge connector wedge as in claim 9 wherein the body comprises an opening at the second end.

11. An electrical wedge connector wedge as in claim 10 wherein the opening comprises a first portion and a second portion, wherein the first portion is adapted to receive a firing ram, and wherein the second portion is adapted to receive a portion of the explosive charge.

12. An electrical wedge connector wedge as in claim 11 wherein the firing pin is at the second portion of the opening.

13. An electrical wedge connector wedge as in claim 9 wherein the body comprises a second conductor groove extending along another side of the body between the first end and the second end.

14. An electrical wedge connector comprising:

an electrical wedge connector sleeve; and an electrical wedge connector wedge as in claim 9, wherein the wedge is insertable into the sleeve, and wherein the connector is adapted to receive a conductor between the wedge and the sleeve.

15. A method of using an electrical wedge connector installation tool comprising:

locating an end of a firing ram proximate an opening an electrical wedge connector wedge;

installing an explosive cartridge in an opening at the end of the firing ram, wherein the explosive cartridge is between the end of the firing ram and the electrical wedge connector wedge;

moving the ram towards the wedge; and striking the explosive cartridge with a firing pin in response to the moving of the ram.

16. A method as in claim 15 wherein the installing of the explosive cartridge further comprises installing the explosive cartridge in the opening of the electrical wedge connector wedge.

17. A method as claim 15 wherein in the firing pin is at the end of the firing ram.

18. A method as in claim 15 wherein the firing pin is at the opening of the electrical wedge connector wedge.

* * * * *